US006243046B1

(12) United States Patent
Aoki

(10) Patent No.: US 6,243,046 B1
(45) Date of Patent: Jun. 5, 2001

(54) ANTENNA SYSTEM FOR MINIMIZING THE SPACING BETWEEN ADJACENT ANTENNA UNITS

(75) Inventor: Katsuhiko Aoki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/269,937

(22) PCT Filed: Jan. 13, 1998

(86) PCT No.: PCT/JP98/00093

§ 371 Date: Apr. 8, 1999

§ 102(e) Date: Apr. 8, 1999

(87) PCT Pub. No.: WO99/36989

PCT Pub. Date: Jul. 22, 1999

(51) Int. Cl.[7] ..... H01Q 3/08
(52) U.S. Cl. ..... 343/765; 343/766; 343/878
(58) Field of Search ..... 343/765, 766, 343/878, 882; H01Q 3/08

(56) References Cited

U.S. PATENT DOCUMENTS 2,408,825 * 10/1946 Varian et al. ..... 343/765
2,740,962 * 4/1956 Hammon, Jr. ..... 343/765
3,028,595 * 4/1962 Cole et al. ..... 343/765
6,043,788 * 3/2000 Seavey ..... 343/765

FOREIGN PATENT DOCUMENTS 551781 1/1980 (JP) .
1197685 8/1989 (JP) .
1233381 9/1989 (JP) .
385471 4/1991 (JP) .

* cited by examiner

*Primary Examiner*—Tan Ho
(74) *Attorney, Agent, or Firm*—Rothwell, Figg, Ernst & Manbeck

(57) ABSTRACT

Two antenna units (11) and (12) are located on a pedestal device (13) provided rotatably around an azimuth angular axis thereof, and a rotating mechanism for rotating in an azimuth angular direction and an elevation angular direction respectively is provided in each of the antenna units (11, 12). The antenna units (11) and (12) execute, for the purpose of communicating with the orbital satellites (81) and (82) respectively, satellites tracking by adjusting its own azimuth angle and elevation angle while moving in association with rotation of the rotating mechanism (14) of the pedestal device (13).

16 Claims, 11 Drawing Sheets

ANTENNA SYSTEM FOR MINIMIZING THE SPACING BETWEEN ADJACENT ANTENNA UNITS

TECHNICAL FIELD

The present invention relates to an antenna system and more particularly, to an antenna system for executing communications with orbital satellites moving at low earth orbits using antenna units which track such satellite.

BACKGROUND ART

At first, description is made for types of antenna unit based on the conventional technology. FIG. 8 is a general view showing an example of an antenna unit based on the conventional technology, FIG. 9 is a view for explaining the principles of the antenna unit shown in FIG. 8, FIG. 10 is a general view showing another example of antenna unit on the conventional technology, FIG. 11 is a view for explaining the principles of the antenna unit shown in FIG. 10, FIG. 12 is a general view showing still another example of the antenna unit on the conventional technology and FIG. 13 is a view for explaining the principles of the antenna unit shown in FIG. 12. Applied to an antenna unit 51 shown in FIG. 8 is an Az (Azimuth)/E1 (Elevation) mount system and the antenna unit is mounted on two axes. As shown in FIG. 9, this antenna unit 51 is so constructed that it can be rotated around an azimuth angular axis 5*b* as well as around an elevation angular axis 51*a*.

Applied to an antenna unit 61 shown in FIG. 10 is a X/Y mount system and the antenna unit is mounted on two axes like in the Az/E1 mount system. This antenna unit 61 is so constructed, as shown in FIG. 11, that it can be rotated around an X axis 61*a* as well as around a Y axis 61*b*.

Applied to an antenna unit 71 shown in FIG. 12 is a HA/DEC mount system and the antenna unit is mounted on two axes like in the Az/E1 mount system or the X/Y mount system. This antenna unit 71 is so constructed, as shown in FIG. 13, that it can be rotated around a HA axis 71*a* as well as around a DEC axis 71*b*. It should be noted that, the technology on this type of antenna units 51, 61 and 71 is described in the reference Antenna Engineering Handbook (edited by Institute of Electronics and Communication Engineers) Chapter 9, Section 5.

Next, description is made for an example in which the antenna unit is applied to a satellite communication system. In recent years, there has received attention on an orbital satellite communication system in which a plurality of satellites are launched in Low Earth Orbits and data transaction is executed through communications with each of the satellites. There is a system called Teledesic in this orbital satellite communication system. In this type of system, each antenna unit located on the ground is required to seize (track) a plurality of orbital satellites one after another while the satellites are within a visible area from the ground and also it is required to continuously insure the communication routes. Namely, each of the antenna units seizes at least two satellites, monitors information for switching satellites by receiving radio waves sent from the satellites all the time, and communicates with the satellites as required through receiving and transmitting radio waves from and to the satellites.

Then, description is made for a relation between an antenna unit and a satellite. FIG. 14 is a view for explaining a positional relation between the conventional type of antenna system and orbital satellites, and FIG. 15 is a view for explaining an example of interference of radio waves in the conventional type of antenna system. In the example of FIG. 14, two antenna units 51 and 52 each having the same construction and function are installed near each other, and a large number of orbital satellites (among them orbital satellites 81, 82 and 83 are shown in the figure) orbit in Low Earth Orbit LEO. Herein the reference numeral R1 shows a radio wave between the antenna unit 51 and an orbital satellite, and the antenna unit 51 receives radio waves from a satellite and transmits radio waves to the satellite if necessary. The reference numeral R2 shows a radio wave between the antenna unit 52 and an orbital satellite, and the antenna unit 52 receives radio waves from the satellite.

The two orbital satellites 81, 82 orbiting (moving in the right direction in the figure) in Low Earth Orbit LEO are tracked by the antenna units 51, 52 respectively, and communication routes are set between the Low Earth Orbit LEO and the ground. Namely, the antenna unit 51 is tracking the orbital satellite 81, and the antenna unit 52 is tracking the orbital satellite 82. At this point of time, for example, the antenna unit 51 performs satellite communication (communications through data transaction) with the orbital satellite 81, and on the other hand the antenna unit 52 receives satellite switching information from the orbital satellite 82.

Then, when the orbital satellite 81 is out of vision from the ground, namely can not be seized by the antenna unit 51, the satellite communications are performed by switching to the communication route formed between the antenna unit 52 and the orbital satellite 82. The timing of this switching is decided according to the satellite switching information sent from the orbital satellite 82 to the antenna unit 52 before switching. This switching is executed instantly. Thus, when switching of satellites is to be performed mechanically, two antenna units 51 and 52 are required. When the satellites are switched, the antenna unit 51 starts tracking the orbital satellite 83 skipping the next orbital satellite 82. Then, for next switching of the satellites because the antenna unit 52 can not seize the orbital satellite 82 any more, the antenna unit 51 starts receiving satellite switching information, from the orbital satellite 83, for switching the communication route used for satellite communications between the antenna unit 52 and orbital satellite 82 to that between the antenna unit 51 and the orbital satellite 83.

As described above, in the next switching of satellites, the antenna unit 51 is required to switch to the orbital satellite 83 as instantaneously as possible, and at that point of time, dead angles need to be reduced as much as possible. Accordingly, when orbital satellites are tracked using the mechanical method, it is important to efficiently perform synchronization between the two antenna units 51 and 52.

In order to achieve this, it is required to provide the antenna units 51 and 52 as close as possible, but if the antenna system is so constructed that one of radio routes comes into even just a portion of the other radio route between the antenna units 51 and 52, interference of radio waves may occur between the radio route L1 in the antenna unit 51 and radio route L2 in the antenna unit 52. Therefore, a blocking portion (interfering portion) Z1 due to radio waves of the antenna unit 51 may occur in the antenna unit 52, and a blocking portion Z2 due to radio waves of the antenna unit 52 may occur in the antenna unit 51, which reduces the reliability of satellite tracking and satellite switching.

The present invention has been made for solving the problem described above, and it is an object of the present invention to obtain an antenna system in which interference does not occur even if a plurality units of antenna unit are provided at the closest possible distance between the devices and also tracking orbital satellites and switching satellites can reliably be executed.

DISCLOSURE OF THE INVENTION

In the present invention, in order to locate a plurality of antenna units each rotating around a plurality of different rotation axes respectively, a plurality of antenna units are arranged on a pedestal device having one rotation axis symmetric with respect to the rotation axis, and each of the antenna units are allowed to rotate around a plurality of different rotation axes, so that each of the antenna units rotates around the rotation axis of the pedestal device and also rotates around the rotation axis of its own, and therefore, it is possible to provide an antenna system in which downsizing of the system can be achieved, interference due to radio waves between antenna units can be avoided when a plurality of orbital satellites are being tracked, and tracking orbital satellites as well as switching satellites can reliably be executed.

Also, in the present invention, each of antenna units located on a pedestal device is set to a same-sized antenna aperture and a distance between antenna units is set to a minimum which is theoretically equal to the antenna aperture, so that it is possible to provide an antenna system in which a distance between antenna units can be set to the necessary minimum value.

Further, when two antenna units are located on a pedestal device, the two antenna units are so located that the center of each of the antenna units and the center of the pedestal device lay on a line, and the antenna aperture and the distance between the antenna units is theoretically equal to each other, and therefore, it is possible to provide an antenna system in which a distance between antenna units can be set to a minimum value.

Further, when three or more of antenna units are located on the pedestal device, distance between at least two of the adjacent antenna units can be theoretically set to the antenna aperture, so that interval between the antenna units is uniform, and therefore, it is possible to provide an antenna system in which the area required for installation of antenna units on the pedestal device needs only the necessary minimum space and redundancy to control tracking a large number of satellites as well as for switching the satellites according to a number of installed antenna units can be realized.

Further, an azimuth angular axis for rotating in an azimuth angular direction is provided in the mechanism for rotating the pedestal, so that it is possible to provide an antenna system in which each of the antenna units located on a pedestal device can be rotated in the azimuth angular direction.

Further, two rotation axes consisting of an azimuth angular axis for rotating in an azimuth angular direction and an elevation angular axis for rotating in an elevation angular direction are provided in the mechanism for rotating the antenna, so that it is possible to provide an antenna system which can adjust each of the azimuth angle and elevation angle by its own in addition to rotation thereof on the pedestal device.

Further, two rotation axes consisting of an X axis for rotating in an X-axial direction and a Y axis for rotating in a Y-axial direction are provided in the mechanism for rotating the antenna, so that it is possible to provide an antenna system which can adjust each of angles in the X-axial direction and the Y-axial direction by its own in addition to rotation thereof on the pedestal device.

Further, two rotation axes consisting of a HA axis for rotating in a HA-axial direction and a DEC axis for rotating in a DEC-axial direction are provided in the mechanism for rotating the antenna, so that it is possible to provide an antenna system which can adjust each of angles in the HA-axial direction and the DEC-axial direction by its own in addition to rotation thereof on the pedestal device.

Further, three rotation axes for rotating in a roll direction, a pitch direction and a yaw direction are provided in the mechanism for rotating the antenna, so that each of angles in the three directions such as roll, pitch and yaw are controlled by its own in addition to rotation thereof on the pedestal device, and therefore, it is possible to provide an antenna system which can prevent gimbals lock when tracking satellites.

Further, an azimuth angular axis of the mechanism for rotating the pedestal makes an angle other that 90 degree to the ground surface, so that it is possible to provide an antenna system which can account for a tilt in the orbit of orbital satellites.

BEST MODE FOR CARRYING OUT THE INVENTION

In order to describe the present invention in more detail, description is made wi th reference to the attached drawings.

Figure 1:
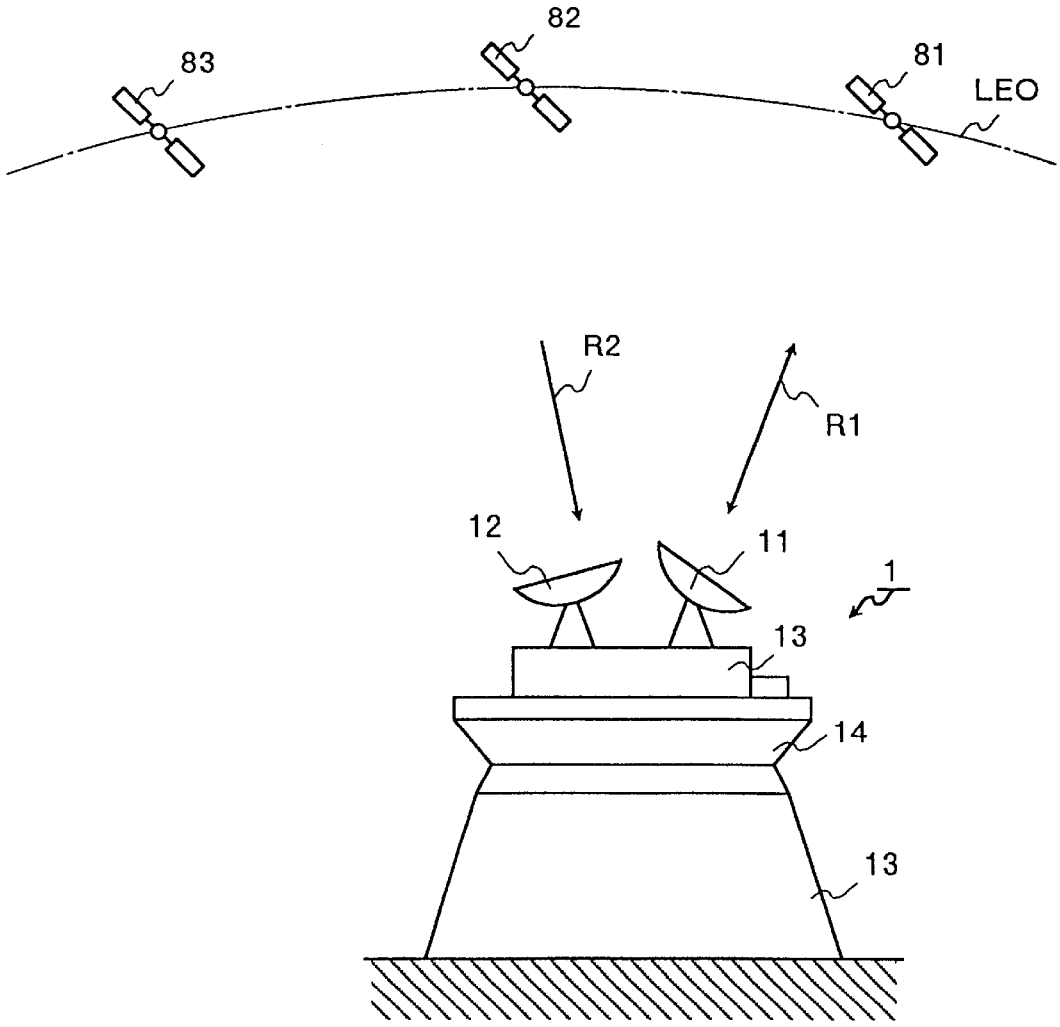
FIG. 1 is a view for explaining a positional relation between an antenna system according to Embodiment 1 of the present invention and orbital satellites.

At first, description is made for Embodiment 1 of the present invention. FIG. 1 is a view for explaining a positional relation between an antenna system according to Embodiment 1 of the present invention and the orbital satellites, and in this figure, the reference numeral 1 stands for the antenna system according to Embodiment 1. This antenna system 1 comprises antenna units 11 and 12 for tracking satellites 81 and 82 respectively; and a pedestal device 13 for mounting thereon and concurrently rotating those antenna units 11 and 12. Herein, each of the antenna units 11 and 12 has a function of rotatably driving a section of an antenna reflecting mirror with two axes of azimuth angle/elevation angle (Az/E1), and the pedestal device 13 has a rotating mechanism 14 for rotatably driving with only one axis of the azimuth angle (Az).

Figure 2:
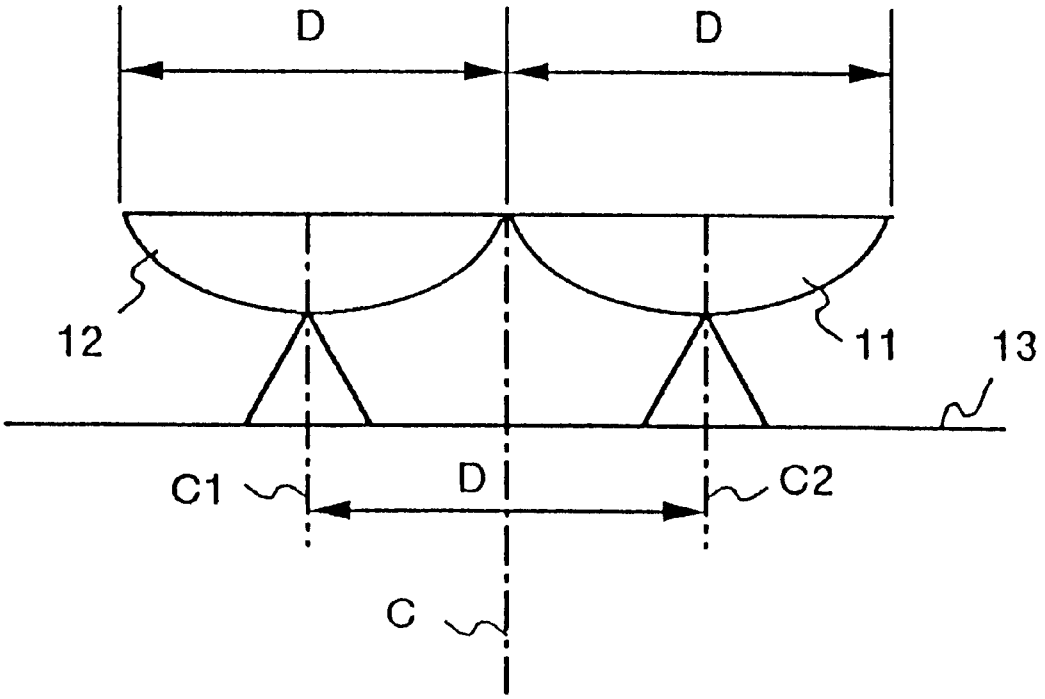
FIG. 2 is a view schematically showing an example of arrangement of antenna units in the antenna system according to Embodiment 1, FIG. 3 are views for explaining the principles of Embodiment 1 of the antenna system according to the present invention, while FIG.3(*a*) is a view of the principles showing an example of a state of the antenna system and FIG. 3(*b*) is a view of the principles showing another example of a state of the antenna system.

Next, description is made for a positional relation between the antenna units 11 and 12. FIG. 2 is a view schematically showing an example of arrangement of antenna units in the antenna system according to Embodiment 1. The distance between the antenna units 11 and 12 is decided according to the antenna aperture of the antenna reflecting mirror. Accordingly, when elevation angles El of both of the antenna units 11 and 12 are zero degree, the distance between edges of the antenna reflecting mirror can be set to the minimum.

Also the antenna units 11 and 12 have an antenna aperture of the same size as shown by a reference sign D. Therefore, the distance between edges of the antenna reflecting mirrors can be theoretically set to zero, and in that case, azimuth angular (Az) axes C2 and C1 of the antenna reflecting mirrors in the antenna units 11 and 12 respectively are arranged at positions symmetric with respect to the azimuth angular axis of the pedestal device 13. With the arrangement as described above, the distance between antenna units 11 and 12 is set to the minimum.

Figure 3:
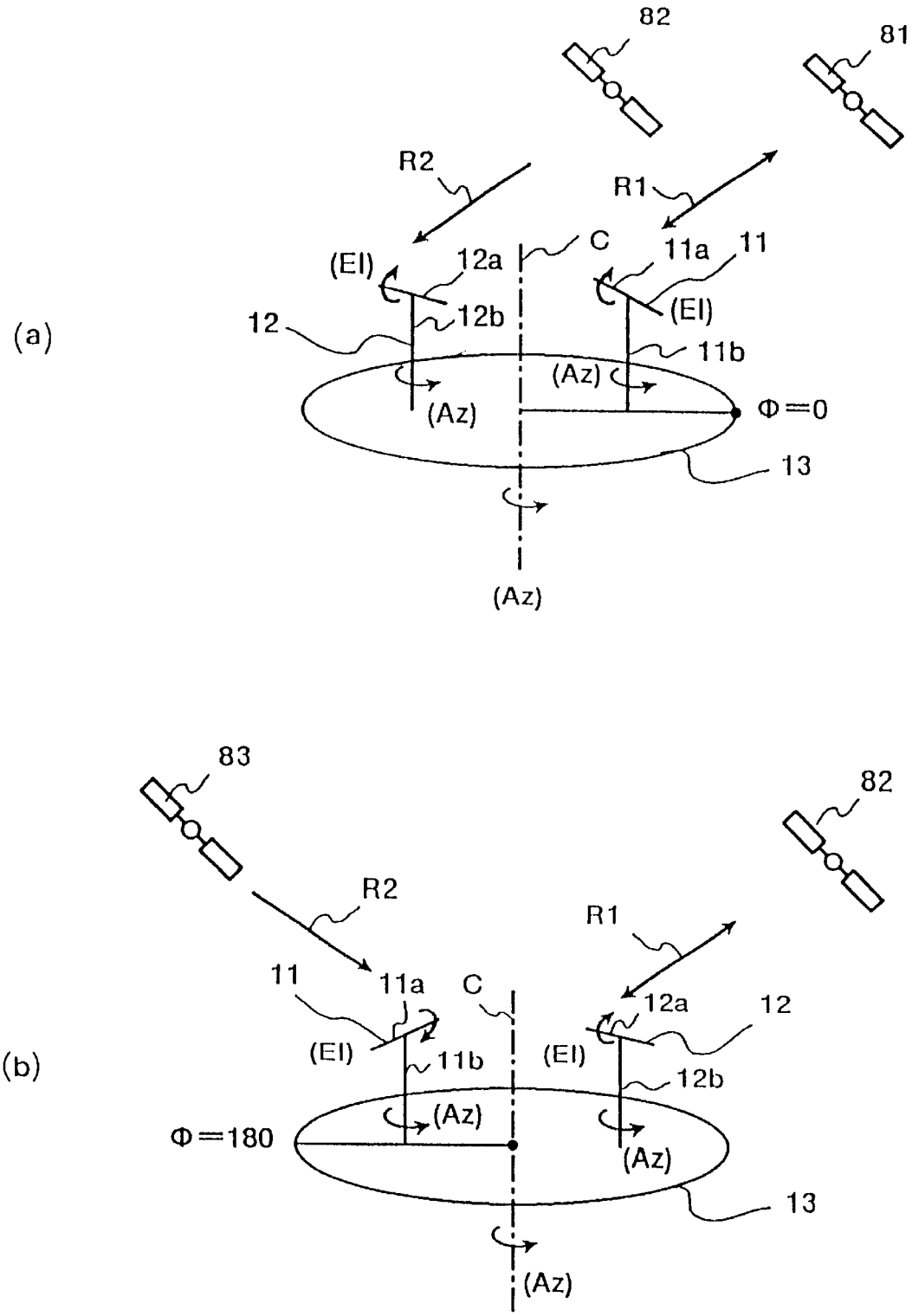

Next, description is made for the principles of the antenna system 1. FIG. 3 is views for explaining the principles of Embodiment 1 of the present invention. FIG. 3(*a*) shows a state of the antenna system 1 when an azimuth angle Az of the pedestal device 13 is zero degree, FIG. 3(*b*) shows a state of the antenna system 1 when the azimuth angle Az is 180 degree. Provided in the pedestal device 13 is, as described above, the rotating mechanism 14 for rotating around the azimuth angular axis C, and the azimuth angle Az of the pedestal device 13 is shown by $\phi$ in the figure.

At first, when the pedestal device 13 has the azimuth angle of $\phi$=0, as shown in FIG. 3, the antenna unit 11 is located in the right side and the antenna unit 12 is located in the left side on the pedestal device 13. At this point of time, it is assumed that the antenna unit 11 is tracking an orbital satellite 81 and the antenna unit 12 is tracking an orbital satellite 82. As the orbital satellites 81, 82 always orbit in Low Earth Orbit LEO, the antenna units 11 and 12 supporting so as not to stop communications with the orbiting satellites 81 and 82 continue to track both the satellites on the ground, and the pedestal device 13 rotates around the azimuth angular axis C according to the tracking. Herein, the antenna units 11, 12 perform tracking by rotating in the direction of the elevation angle E1 around elevation angular axes 11*a*, 12*a* respectively and also rotating in the direction of the azimuth angle Az around azimuth angular axes 11*b*, 12*b* respectively.

The tracking is continued as described above, and when the pedestal device 13 comes in a state of, for example, $\phi$=180, the antenna unit 11 seizes an orbital satellite 82 to switch the satellites as described above. On the other hand, the antenna unit 12 is tracking the orbital satellite 82 during this period. Due to this tracking by the antenna unit 12, when the antenna unit 11 switches from the orbital satellite 81 to the orbital satellite 83 for seizing, the antenna unit 12 evades the radio route for the antenna unit 11, which can avoid interference between radio routes of the antenna units. Namely, there is constructed a system in which radio waves in either of radio routes will not be blocked by those in the other radio route and vice versa between the antenna units 11 and 12. Therefore, interference may not occur even if a plurality of antenna unit are provided at the closest possible distance between the devices, and it is also possible to reliably execute tracking orbital satellites and switching of the satellites.

Also, by setting a small distance between the antenna units 11 and 12, there are merits as follows. Namely:

(1) A connecting distance for the common electronic equipment (transmitter/receiver, modulator/demodulator etc.) connected to each of the antenna units 11 and 12 can be made smaller.

(2) As only a space for installation of one pedestal device 13 is required to be insured, space efficiency for installation of the antenna system can be upgraded.

(3) When a radome is to be covered over each of the antenna units 11 and 12, a small-sized radome can be formed.

(4) The installation becomes easier because of the merits (1) to (3). These merits are enhanced especially when the antenna system according to the present invention is mounted on the roof of a house.

Next description is made for Embodiment 2 of the present invention. Although the description has been made in Embodiment 1 for the antenna system for executing communications with the orbital satellites using two antenna units 11 and 12, the present invention may provide more than two antenna units, like in Embodiment 2 described below, according to requests for switching satellites from the system, antenna construction, and performance thereof or the like. It should be noted that the antenna system according to Embodiment 2 is the same as that of Embodiment 1 except in the number of antenna units mounted on the pedestal device, and therefore, description is made herein only for the different principle.

Figure 4:
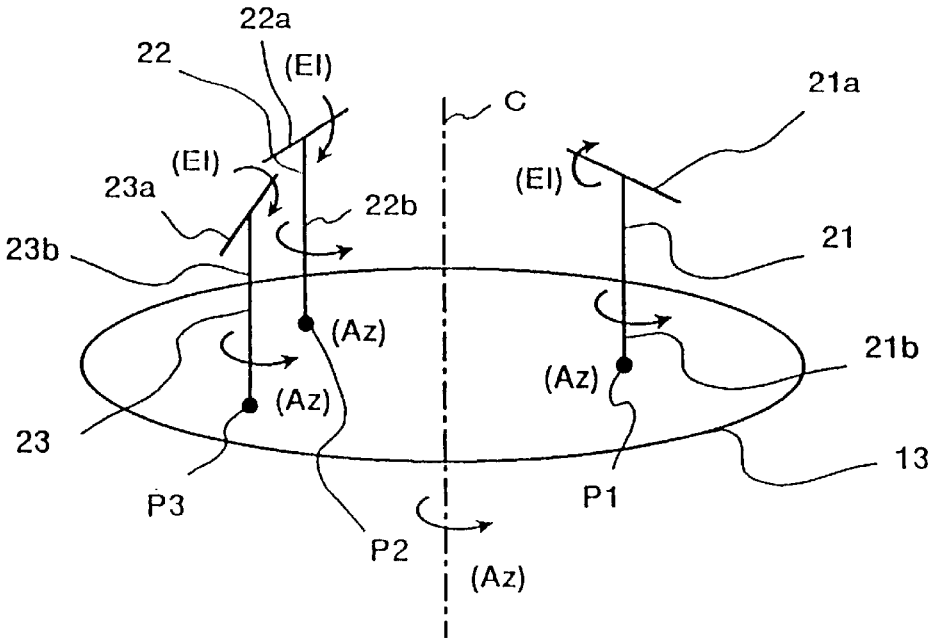
FIG. 4 is a view for explaining the principles of Embodiment 2 of the antenna system according to the present invention.

FIG. 4 is a view for explaining the principles of Embodiment 2 of the antenna system according to the present invention. The antenna system according to Embodiment 2 has, as shown in FIG. 4, three antenna units 21, 22 and 23 located on the pedestal device 13 (Refer to FIG. 1). The antenna units 21, 22 and 23 perform a tracking of the orbital satellites by rotating in the elevation angular direction E1 about elevation angular axes 21*a*, 22*a* and 23*a* respectively as well as by rotating in the azimuth angular direction Az about azimuth angular axes 21*b*, 22*b* and 23*b* respectively. Herein, the reference numerals P1, P2 and P3 represent base points of azimuth angular axes of the antenna units 21, 22 and 23 respectively.

Figure 5:
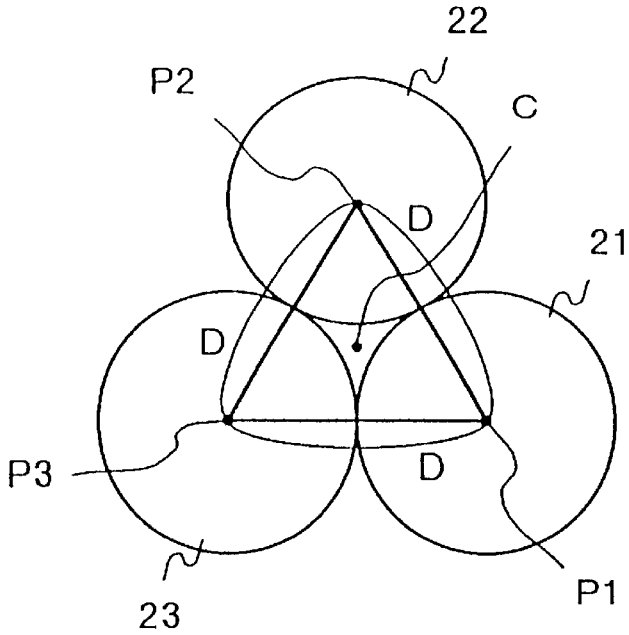
FIG. 5 is a view schematically showing an example of arrangement of antenna units in the antenna system according to Embodiment 2.

Then, description is made for a relation between the antenna units 21, 22 and 23. FIG. 5 is a view schematically showing an example of arrangement of antenna units in the antenna system according to Embodiment 2. In Embodiment 2, as three antenna units 21, 22 and 23 are mounted on the pedestal device 13, the arrangement is different from that of Embodiment 1. Namely, assuming that antenna aperture of each of the antenna units 21, 22 and 23 is D as is in Embodiment 1, and if distance between each of the base points P1, P2 and P3 and the azimuth angular axis C of the pedestal device 13 is taken to be uniform and also distance between each base points is taken uniformly as D, it is theoretically possible to set a distance between antennas to be zero like in Embodiment 1 even if three antenna units 21, 22 and 23 are located thereon.

As described above, the same effect as that of Embodiment 1 can be obtained herein even if three antenna units 21, 22 and 23 are located on the pedestal device 13. Further, distance between at least two adjacent antenna units in the antenna units 21, 22 and 23 can be theoretically set equal to the antenna aperture, and therefore, interval between antenna units is uniform, and it requires only a necessary minimum area for location of the three antenna units 21, 22 and 23 on the pedestal device 13.

Also, in Embodiment 2, although the description has assumed the case where three antenna units are installed, the present invention is not limited to this, and four or more antenna units may be installed. When more antenna units are installed, redundancy in controlling tracking of a large number of satellites as well as for switching the satellites according to a number of installed antenna units can be realized.

Next, description is made for Embodiment 3 of the present invention. Although the description has assumed, in Embodiments 1 and 2, the case where the antenna system for executing communications with the orbital satellites using antenna units each having two rotation axes, in the present invention, an antenna unit having three or more rotation axes may be applied, like in Embodiment 3 described below, to the antenna system. Herein, a case where an antenna unit has three axes of roll (R), pitch (P) and yaw (Y) will be explained as an example. It should be noted that, the antenna system according to Embodiment 3 is the same as that according to Embodiment 1 except in the construction of rotation axes of the antenna unit mounted on the pedestal device, and therefore, description is made herein only for the different principles.

Figure 6:
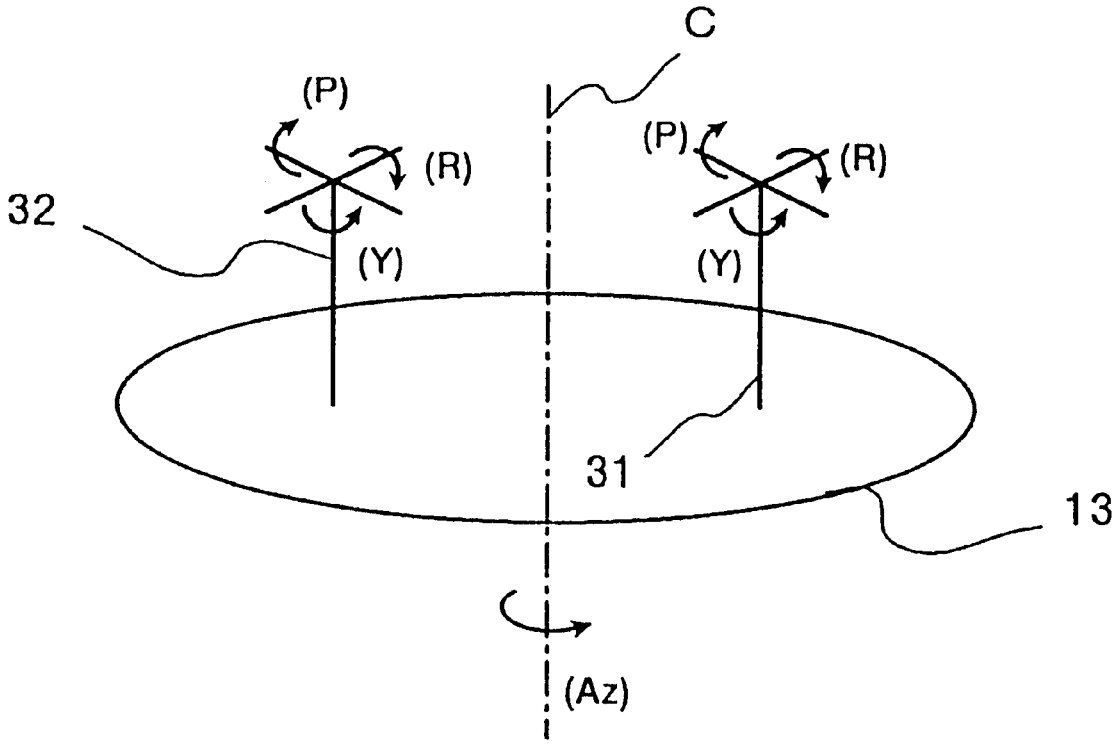
FIG. 6 is a view for explaining the principles of Embodiment 3 of the antenna system according to the present invention.

FIG. 6 is a view for explaining the principles of Embodiment 3 of the antenna system according to the present invention. The antenna system according to Embodiment 3 has, as shown in FIG. 6, two antenna units 31 and 32 located on the pedestal device 13 (Refer to FIG. 1). Both of the antenna units 31 and 32 perform a tracking of the orbital satellites by rotating in roll (R), pitch (P) and yaw (Y) angular directions.

As described above, three rotation axes rotating in the roll direction, pitch direction and yaw direction are provided on the antenna-side rotating mechanism, so that each of angles in the three directions such as roll, pitch and yaw are adjusted by its own in addition to rotation thereof on the pedestal device. Thus, it is possible to prevent gimbals lock when satellites are being tracked. Furthermore, the same effect as that in Embodiment 1 can also be obtained in Embodiment 3, and three antenna units having the same construction and functions as those in the antenna units 31 and 32 can be located based on the arrangement of the antenna units according to Embodiment 2.

Next, description is made for Embodiment 4 of the present invention. In Embodiments 1, 2 and 3, the description has assumed the case of the pedestal device rotating about the azimuth angular axis vertically provided on the ground, but like Embodiment 4 the present invention may have a construction such that the azimuth angular axis is tilted with respect to the ground. It should be noted that the antenna system according to Embodiment 4 is the same as that according to Embodiment 1 excluding the construction of the pedestal device, so that description is made herein only for the different principles.

Figure 7:
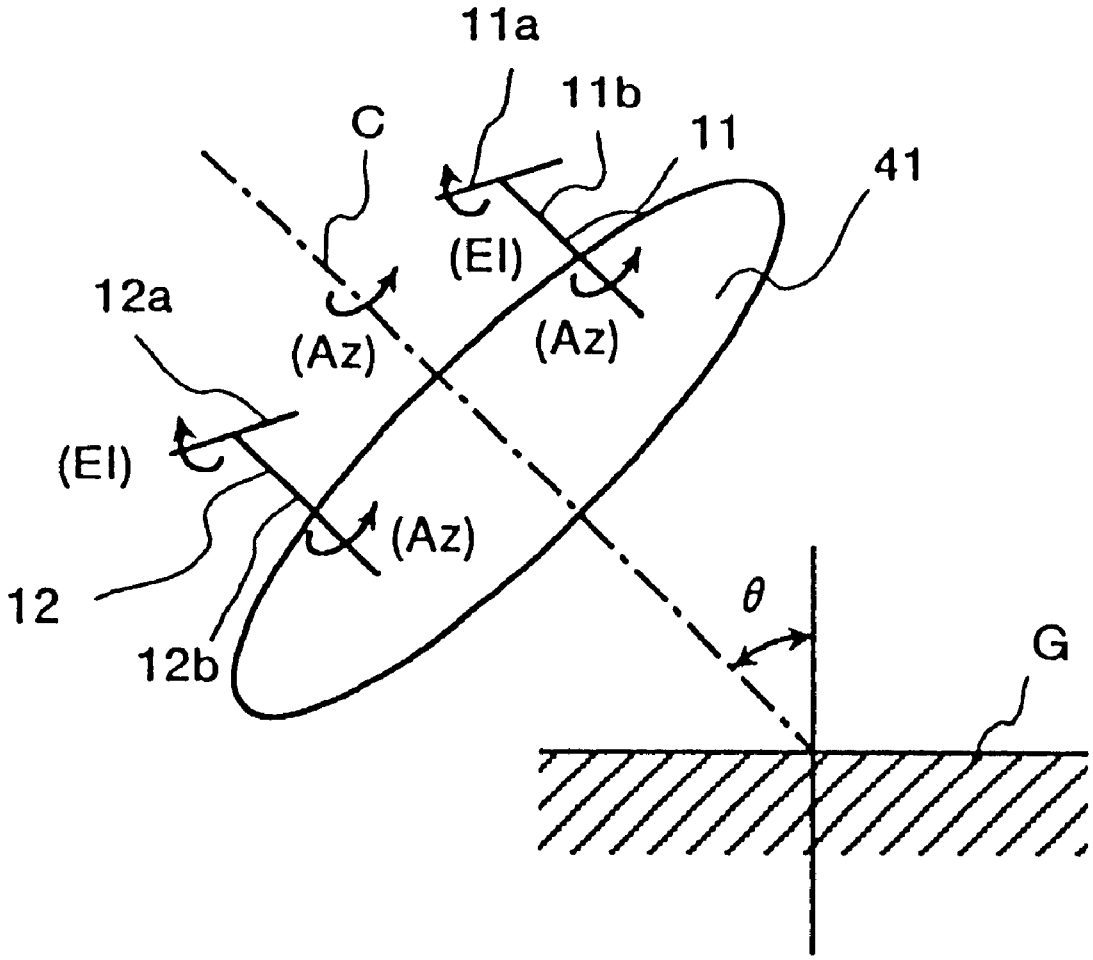
FIG. 7 is a view for explaining the principles of Embodiment 4 of the antenna system according to the present invention.
Figure 8:
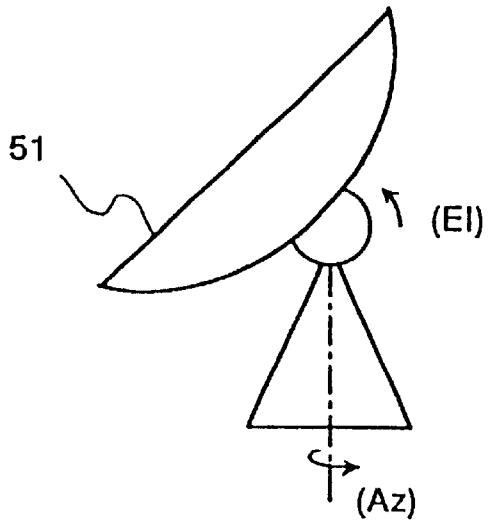
FIG.8 CONVENTIONAL ART
FIG. 8 is a general view showing an example of antenna unit based on the conventional technology.
Figure 9:
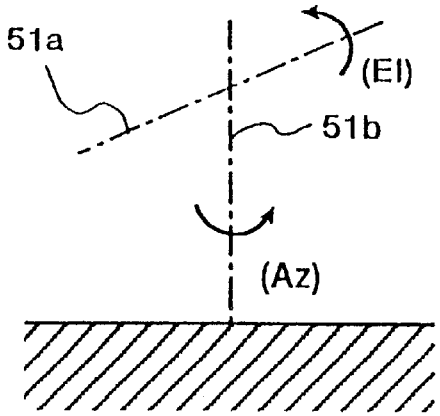
FIG.9 CONVENTIONAL ART
FIG. 9 is a view for explaining the principles of the antenna unit shown in FIG. 8.

FIG. 7 is a view for explaining the principles of Embodiment 4 of the antenna system according to the present invention. The antenna system according to Embodiment 4 has, as shown in FIG. 7, a pedestal device 41 installed therein with antenna units 11 and 12 mounted thereon like in Embodiment 1 and with a rotation axis, namely an azimuth angular axis thereof tilted only by an angle of θ toward the ground surface G. As the antenna units 11 and 12 are located on the pedestal device 41 in the same relation as that in FIG. 2, the operation of tracking orbital satellites and switching the satellites is performed in the same manner as that in Embodiment 1.

Therefore, it is needless to say that the same effects as that in Embodiment 1 can be obtained even if the azimuth angular axis of the pedestal device 41 is tilted with respect to the ground, and it is possible to construct a system accounting the tilt of the orbit of orbital satellites. Furthermore, the same effects as that in each Embodiments 2 and 3 can also be obtained in Embodiment 4 based on the arrangement of the antenna units and each construction of rotation axes thereof according to Embodiments 2 and 3.

Figure 10:
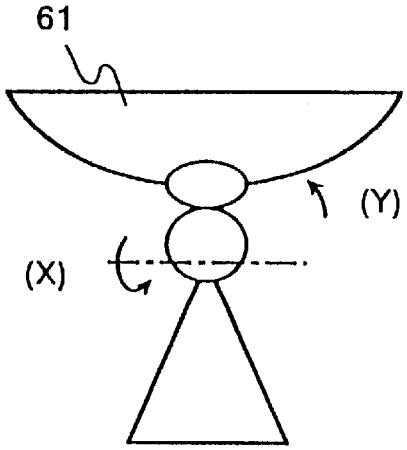
FIG.10 CONVENTIONAL ART
FIG. 10 is a general view showing another example of the antenna unit based on the conventional technology.
Figure 11:
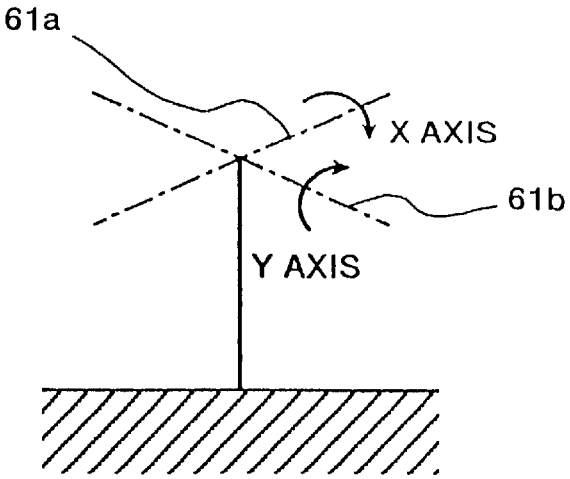
FIG.11 CONVENTIONAL ART
FIG. 11 is a view for explaining the principles in another example of the antenna unit based on the conventional technology.
Figure 12:
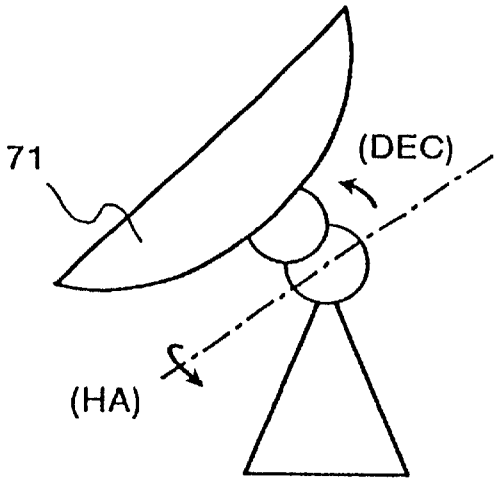
FIG.12 CONVENTIONAL ART
FIG. 12 is a general view showing still another example of the antenna unit based on the conventional technology.
Figure 13:
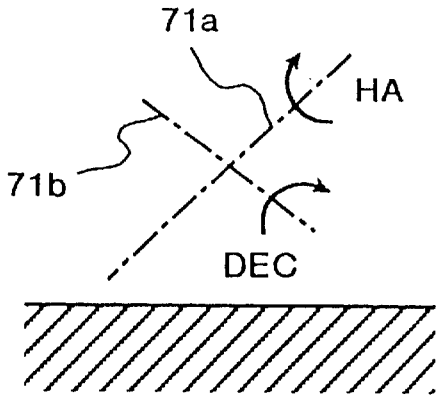
FIG.13 CONVENTIONAL ART
FIG. 13 is a view for explaining the principles in the still another example of the antenna unit based on the conventional technology.
Figure 14:
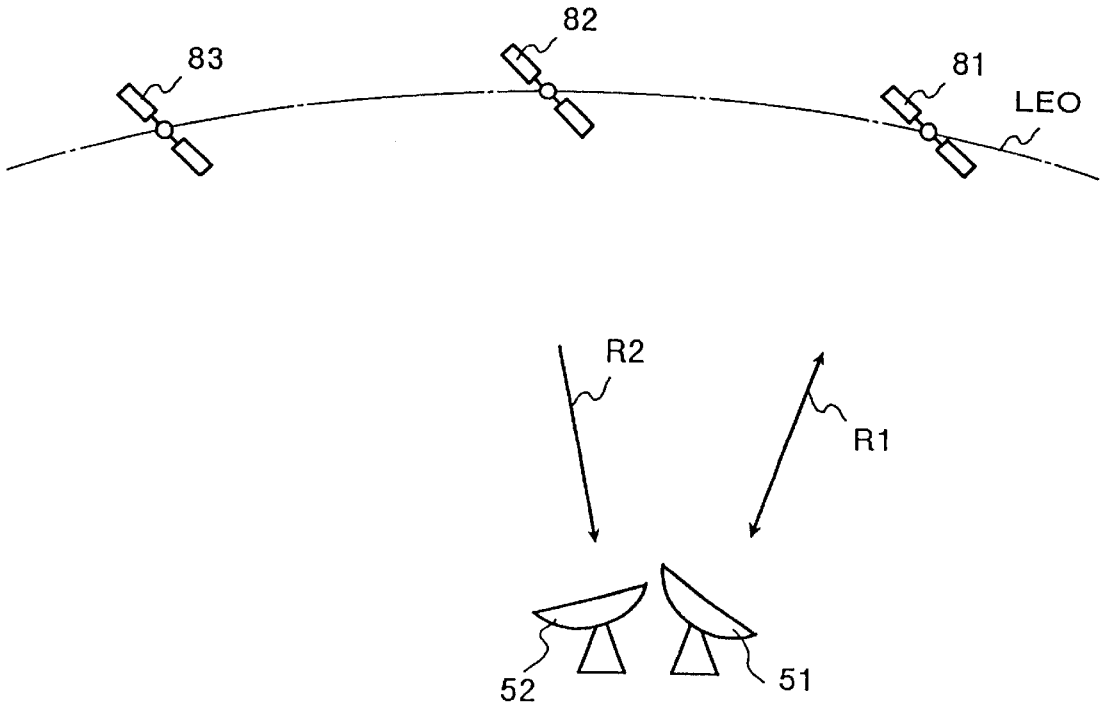
FIG. 14 is a view for explaining a positional relation between the conventional type of antenna system and orbital satellites.
Figure 15:
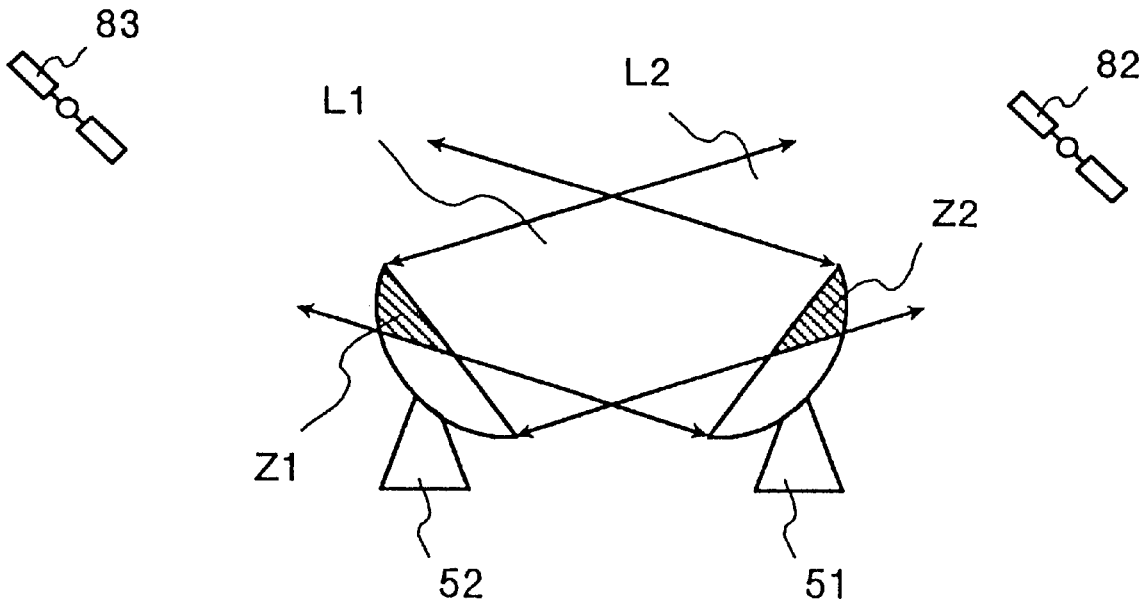
FIG. 15 is a view for explaining an example of interference of radio waves in the conventional type of antenna system.

Although the Az/E1 mount system is applied to each of Embodiments 1, 3 and 4 as a construction of an antenna unit, the present invention is not limited to this, and the same tracking function as the two axes-rotating mechanism can be obtained even if the X/Y mount system or the HA/DEC mount system are employed. Namely, two rotation axes consisting of the X axis rotating in the X-axial direction and the Y axis rotating in the Y-axial direction are provided in the mechanism for rotating the antenna, so that it is possible to adjust each of angles in the X-axial direction and Y-axial direction by its own in addition to rotation thereof on the pedestal device. Furthermore, two rotation axes consisting of the HA axis rotating in the HA-axial direction and the DEC axis rotating in the DEC-axial direction are provided in mechanism for rotating the antenna, so that it is possible to adjust each of angles in the HA-axial direction and DEC-axial direction by its own in addition to rotation thereof on the pedestal device. Construction of the X/Y mount system and the HA/DEC mount system is already shown in FIG. 10 and FIG. 12 respectively, so that the figures are omitted to avoid repetation.

INDUSTRIAL APPLICABILITY

As described above, the antenna system according to the present invention is useful as a compact antenna system in a small-sized earth station for orbital satellites because a distance between antennas can be made smaller.

What is claimed is:

1. An antenna system comprising:

a plurality of antenna units each having a mechanism for rotating the antenna units around a plurality of different rotation axes respectively; and a pedestal device having a mechanism for rotating the pedestal device and holding said plurality of antenna units collectively and rotating all of said antenna units around one rotation axis; wherein said pedestal device has a construction such that said plurality of antenna units are arranged symmetrically with respect to the rotation axis of said mechanism for rotating said pedestal device; and wherein each of said plurality of antenna units has an antenna aperture of the same size. and the minimum value of a distance between antenna units is theoretically set equal to the size of said antenna aperture.

2. An antenna system according to claim 1; wherein, when two of said antenna units are located on said pedestal device, said two antenna units are located so that the center of each of said antenna units and the center of said pedestal device lay on a line.

3. An antenna system according to claim 2; wherein an azimuth angular axis rotating in an azimuth angular direction is provided in said mechanism for rotating said pedestal.

4. An antenna system according to claim 1; wherein, when three or more of said antenna units are located on said pedestal device, a distance between at least two of the adjacent antenna units is theoretically set equal to the size of said antenna aperture.

5. An antenna system according to claim 4; wherein an azimuth angular axis rotating in an azimuth angular direction is provided in said mechanism for rotating said pedestal.

6. An antenna system according to claim 1; wherein an azimuth angular axis rotating in an azimuth angular direction is provided in said mechanism for rotating said pedestal.

7. An antenna system according to claim 6; wherein two rotation axes consisting of an azimuth angular axis rotating in an azimuth angular direction and an elevation angular axis rotating in an elevation angular direction are provided in said mechanism for rotating said antenna units.

8. An antenna system according to claim 7; wherein an azimuth angular axis of said mechanism for rotating said pedestal is located at an angle to the ground surface.

9. An antenna system according to claim 6; wherein two rotation axes consisting of an X axis rotating in an X-axial direction and a Y axis rotating in a Y-axial direction are provided in said mechanism for rotating said antenna units.

10. An antenna system according to claim 9; wherein an azimuth angular axis of said mechanism for rotating said pedestal is located at an angle to the ground surface.

11. An antenna system according to claim 6, wherein two rotation axes consisting of a HA axis rotating in a HA-axial direction and a DEC axis rotating in a DEC-axial direction are provided in said mechanism for rotating said antenna units.

12. An antenna system according to claim 11; wherein an azimuth angular axis of said mechanism for rotating said pedestal is located at an angle to the ground surface.

13. An antenna system according to claim 6; wherein three rotation axes rotating in a roll direction, a pitch direction and a yaw direction respectively are provided in said mechanism for rotating said antenna units.

14. An antenna system according to claim 13; wherein an azimuth angular axis of said mechanism for rotating said pedestal is located at an angle to the ground surface.

15. An antenna system according to claim 6; wherein an azimuth angular axis of said mechanism for rotating said pedestal is located at an angle to a ground surface.

16. An antenna system according to claim 1; wherein an azimuth angular axis rotating in an azimuth angular direction is provided in said mechanism for rotating said pedestal.

* * * * *

UNITED STATES PATENT AND TRADEMARK OFFICE

CERTIFICATE OF CORRECTION

PATENT NO. : 6,243,046 B1
DATED : June 5, 2001
INVENTOR(S) : Katsuhiko Aoki

It is certified that error appears in the above-identified patent and that said Letters Patent is hereby corrected as shown below:

Column 1,
Lines 24, 31 and 36, "E1" should be -- El --.
Line 27, "5*b*" should read -- 51b --.

Column 4,
Line 19, "that" should be -- than --.

Column 5,
Line 9, "wi th" should be -- with --.
Line 22, "E1" should be -- El --.

Column 6,
Lines 1 and 59, "E1" should b -- El --.
Line 7, "82" should be -- 83 --.

Column 8,
Line 30, "E1" should be -- El --.

Signed and Sealed this

Thirtieth Day of July, 2002

*Attest:*

*Attesting Officer*

JAMES E. ROGAN
*Director of the United States Patent and Trademark Office*